US010458094B2

(12) United States Patent
Weaver

(10) Patent No.: US 10,458,094 B2
(45) Date of Patent: Oct. 29, 2019

(54) VERSATILE CONNECTOR FOR EXCAVATOR TOOLS

(71) Applicant: Adam Weaver, Benton, LA (US)

(72) Inventor: Adam Weaver, Benton, LA (US)

( * ) Notice: Subject to any disclaimer, the term of this patent is extended or adjusted under 35 U.S.C. 154(b) by 0 days.

(21) Appl. No.: 15/631,801

(22) Filed: Jun. 23, 2017

(65) Prior Publication Data

US 2018/0038062 A1 Feb. 8, 2018

Related U.S. Application Data

(60) Provisional application No. 62/353,905, filed on Jun. 23, 2016.

(51) Int. Cl.
*E02F 3/36* (2006.01)
*E02F 3/96* (2006.01)

(52) U.S. Cl.
CPC ..... *E02F 3/3636* (2013.01); *E02F 3/3609* (2013.01); *E02F 3/3686* (2013.01); *E02F 3/963* (2013.01)

(58) Field of Classification Search
CPC ..... E02F 3/3609
See application file for complete search history.

(56) References Cited

U.S. PATENT DOCUMENTS 4,948,328 A * 8/1990 Busch ..... E02F 3/3636 172/273
RE33,454 E * 11/1990 Potter ..... E02F 3/60 172/719
5,063,695 A * 11/1991 Briscoe ..... E02F 9/28 172/753
5,241,765 A * 9/1993 Jones ..... E02F 3/60 172/772
5,394,630 A * 3/1995 Moinat ..... E02F 3/364 172/272
6,499,904 B2 * 12/2002 Nye ..... E02F 3/364 37/468
8,528,239 B2 * 9/2013 Andrina ..... E02F 3/3613 37/468
2016/0273184 A1 * 9/2016 Andrina ..... E02F 3/3613

FOREIGN PATENT DOCUMENTS

| | | | | |
|---|---|---|---|---|
| DE | 8700947 | * | 5/1987 | |
| EP | 312489 | A1 * | 4/1989 | |
| EP | 467837 | A1 * | 1/1992 | |
| EP | 609176 | A1 * | 8/1994 | |
| EP | 1353011 | A1 * | 10/2003 | ..... E02F 3/3613 |
| FR | 2683239 | A1 * | 5/1993 | ..... E02F 3/364 |
| JP | 08218413 | A * | 8/1996 | ..... E02F 3/3609 |
| JP | 2000104276 | A * | 4/2000 | ..... E02F 3/3613 |

OTHER PUBLICATIONS

Definition of "pin", Oxford English Dictionary, http://www.oed.com/view/Entry/144028?rskey=lbGjly&result=1&isAdvanced=false&print (accessed on Feb. 15, 2019), pp. 1-2 (Year: 2019).*
"Addressing 35 U.S.C. § 112(f) or "Means-plus-Function" Limitations in an Office Action using New Form Paragraphs", USPTO, Sep. 2017, https://www.uspto.gov/sites/default/files/documents/112f_cbt_slides.pdf (accessed on Feb. 15, 2019), pp. 1-7 (Year: 2017).*

* cited by examiner

*Primary Examiner* — Gerald McClain
(74) *Attorney, Agent, or Firm* — Matthew Warner-Blankenship; Davis Brown Law Firm

(57) ABSTRACT

An adaptor for quickly, easily, and safely attaching and removing compatible tools from the end of a boom of an excavating machine.

16 Claims, 20 Drawing Sheets

VERSATILE CONNECTOR FOR EXCAVATOR TOOLS

CROSS-REFERENCE TO RELATED APPLICATION(S)

This application claims priority under 35 U.S.C. § 119(e) to U.S. Provisional Application No. 62/353,905, entitled "VERSATILE CONNECTOR FOR EXCAVATOR TOOLS," filed Jun. 23, 2016, which is hereby incorporated by reference in its entirety for all purposes.

TECHNICAL FIELD

The disclosed embodiments relate generally to a versatile connector for rapidly attaching and shifting compatible tools to machinery, more specifically an excavator, and to tools adapted for use therewith.

BACKGROUND

Hydraulically actuated excavators and tools attached to and used with excavators are in ubiquitous use throughout the world. One example is the PC210LC-10 model sold by Komatsu Ltd. (Tokyo, Japan). Excavators typically have a hydraulically actuated boom at the end of which may be attached a variety of tools for carrying out the desired earth-working tasks, such as excavating, compacting, removing rocks, building materials, tree stumps, and the like. Existing excavators require considerable time and labor in swapping out such tools. Such swapping of tool can also be difficult. Accordingly, there is a need in the industry for a quick, easy, one-man apparatus and method for changing from one desired tool to another.

BRIEF SUMMARY

The disclosed embodiments consist of an adaptor that is attached to the end of a boom of an excavator to permit the safe, rapid changing of compatible tools. Such tools may be sized consistent with the adaptor to allow for mounting on the end of the boom by a single person. It is understood that other embodiments of the disclosure will become apparent to those skilled in the art from the following detailed description, which shows and describes illustrative embodiments of the disclosed device and system.

DETAILED DESCRIPTION

The various disclosed devices, systems and methods relate to the selective mounting of a tool or tools on the end of an excavator boom or other implement, as would be readily appreciated by one of skill in the art. In certain embodiments, the devices, systems and methods described herein may be used to improve safety and speed in changing compatible tools to be used in conjunction with an excavator boom.

Figure 1A:
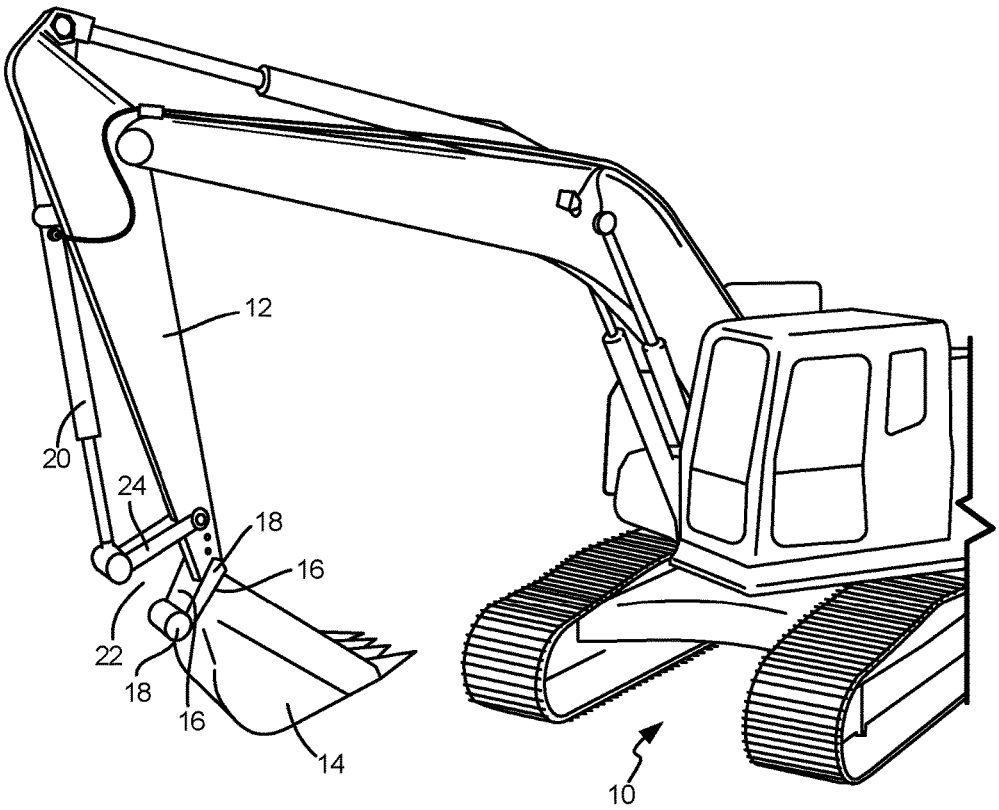
FIG. 1A (PRIOR ART)
FIG. 1A is a perspective view of an exemplary excavator machine, the Komatsu Model PC2110LC-10.

Turning to the drawings in greater detail, FIG. 1A depicts an excavator 10, of the type suitable for application of the disclosed connection or adaptation device 30. It is understood that in various implementations, an excavator 10 has a hydraulically actuated boom 12 to the end of which is attached, in various implementations. In one example, an excavating bucket 14. Other embodiments of the disclosed hydraulically actuated boom would be apparent to those of skill in the art. The bucket 14 is attached to the boom 12 via an ear 16 or ears 16. In some implementations pins 18 may also be used for attachment. The bucket 14 may be pivoted about the end of the boom 12 by a hydraulic cylinder 20 acting on links 22 and 24. It is understood that other embodiments of the bucket-boom implementation would be known to those skilled in the art.

Figure 2A:
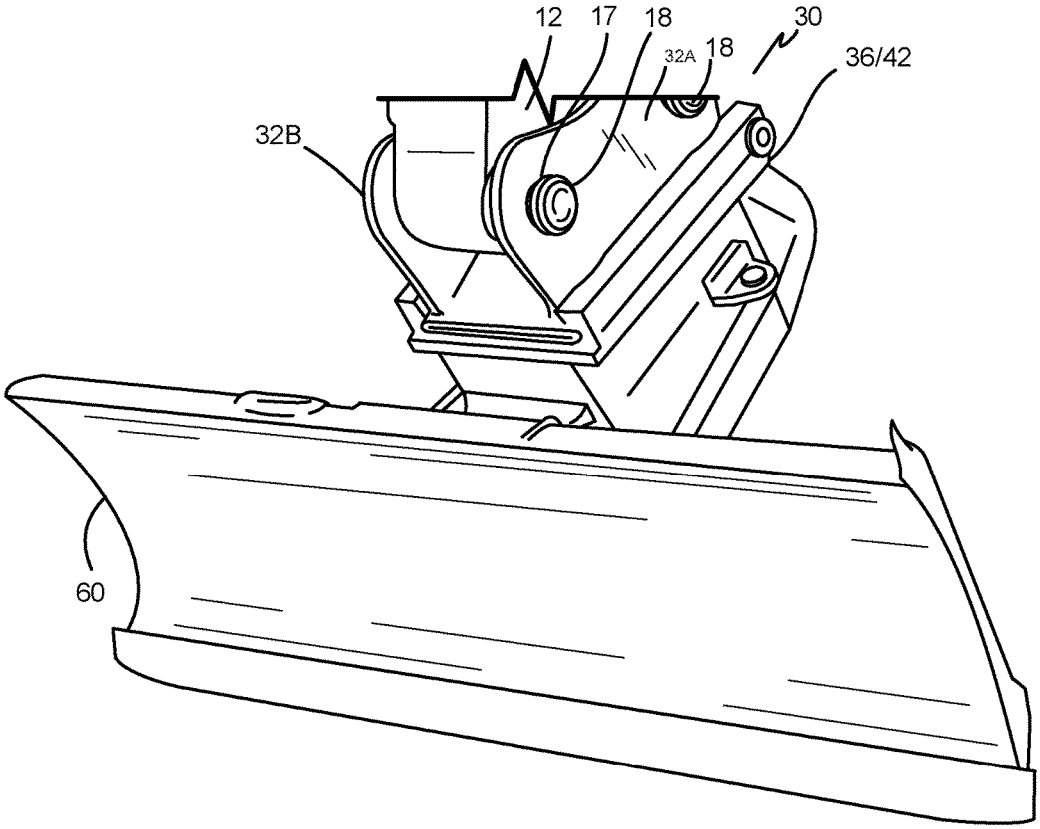
FIG. 2A is a three-dimensional rendering of the adaptor attached to a dozer blade modified for use with the adaptor, according to one implementation.
Figure 2B:
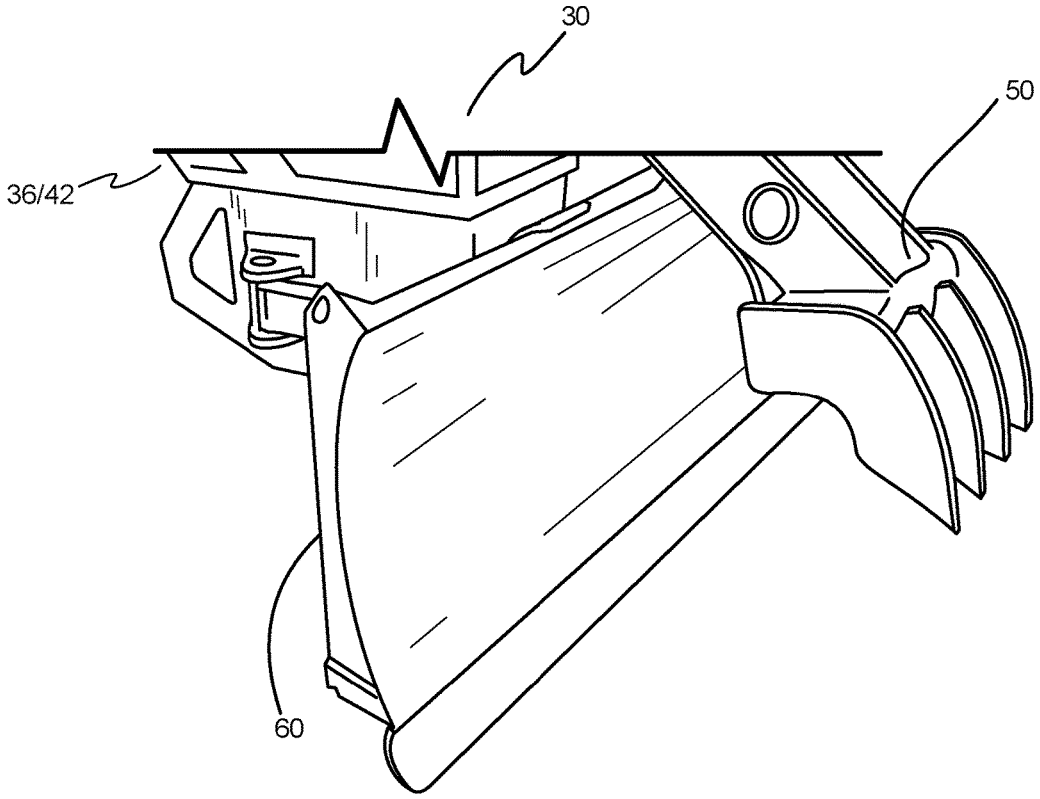
FIG. 2B is a three-dimensional rendering of tool comprising a dozer blade and a grapple, modified for use with the adaptor, according to one implementation.
Figure 3A:
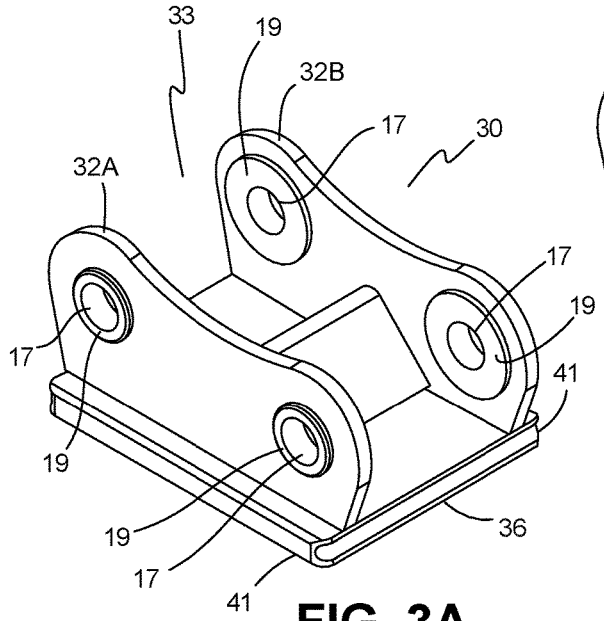
FIGS. 3A-3G depict the adaptor, according to some implementations.
Figure 3B:
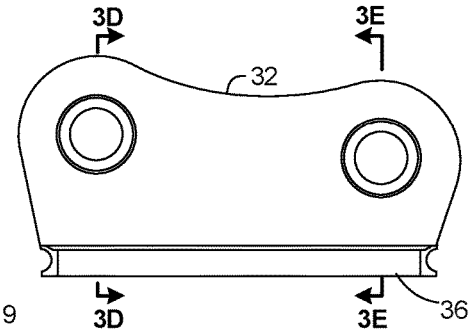
Figure 3C:
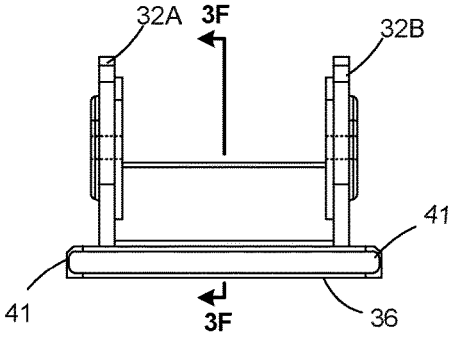
Figure 3D:
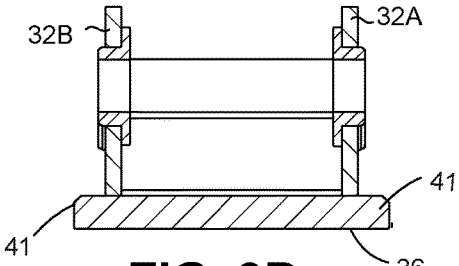
Figure 3E:
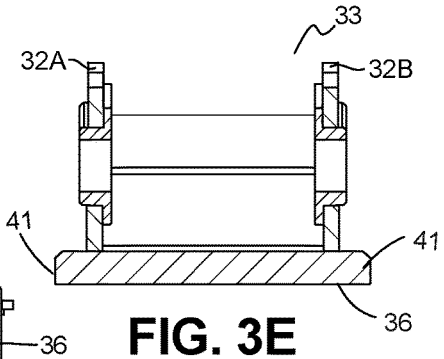
Figure 3F:
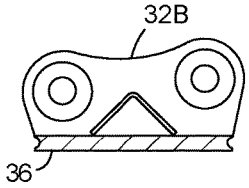
Figure 3G:
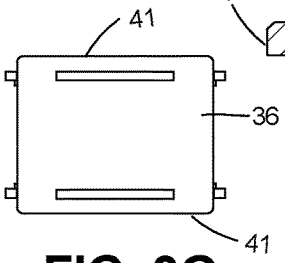
Figure 4A:
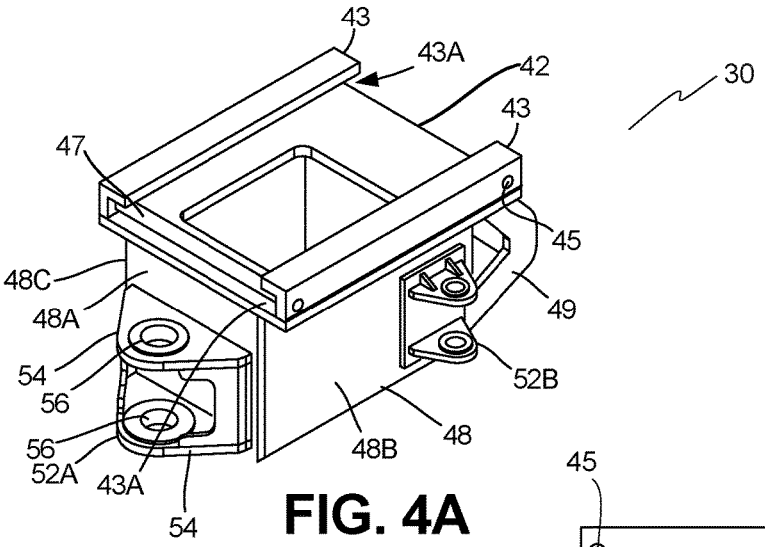
FIGS. 4A-4I depict the attachment plate and housing, according to some implementations.
Figure 4B:
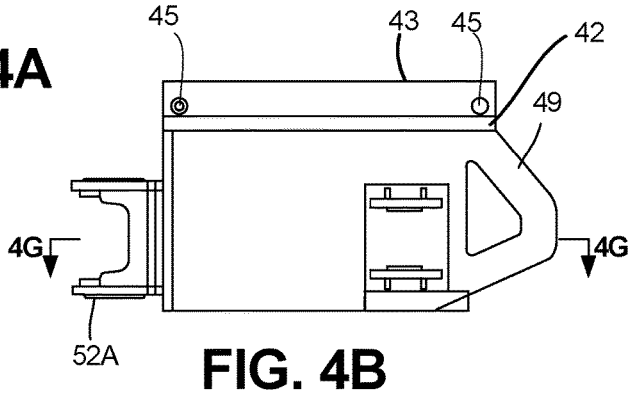
Figure 4C:
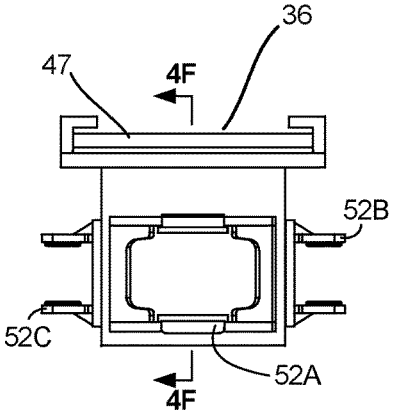
Figure 4D:
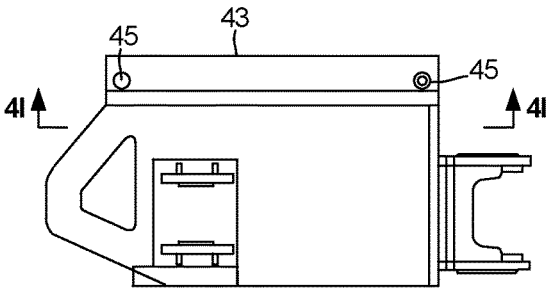
Figure 4E:
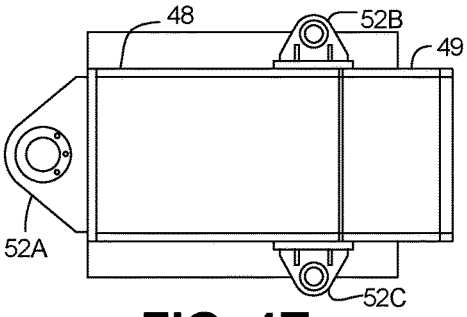
Figure 4F:
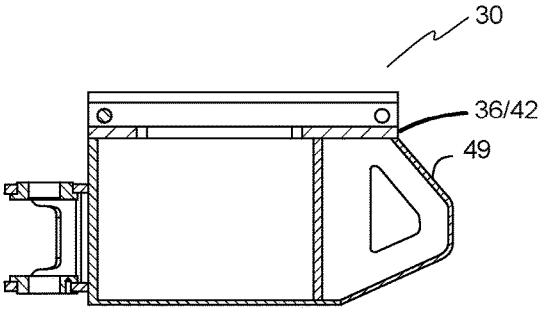
Figure 4G:
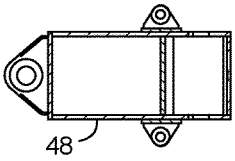
Figure 4H:
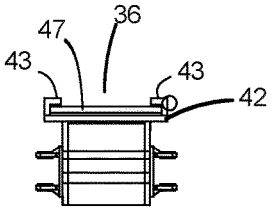
Figure 4I:
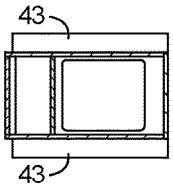
Figure 5A:
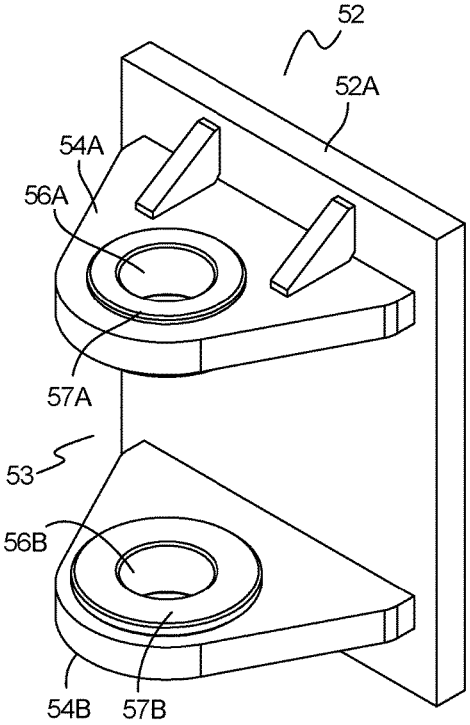
FIGS. 5A-5E depict the bracket and tool flanges, according to some implementations.
Figure 5B:
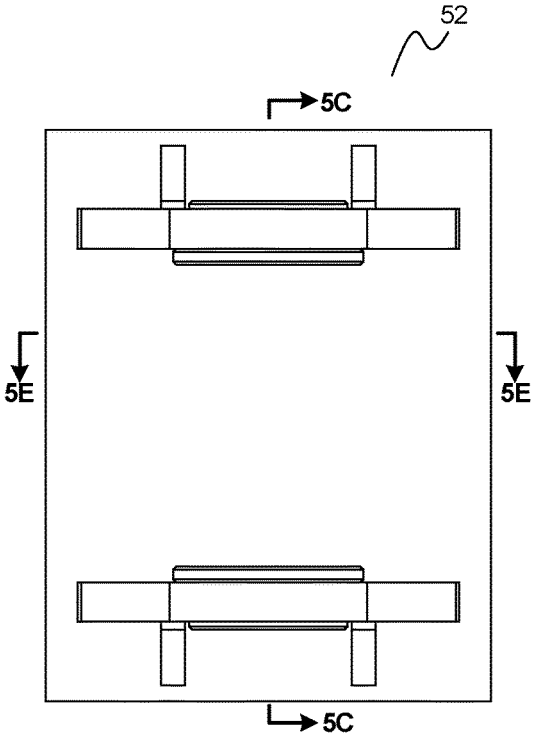
Figure 5C:
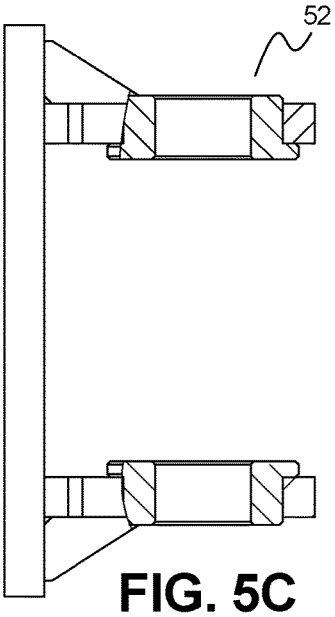
Figure 5D:
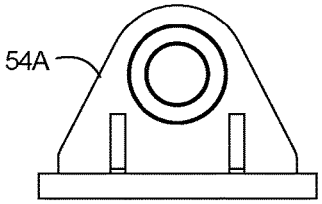
Figure 5E:
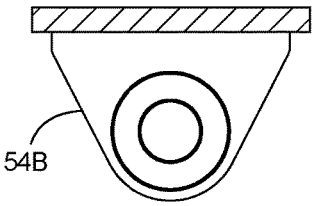

Several implementations of a rapid release or change device 30 for mounting a tool on the boom are illustrated in FIGS. 2A-2B and 3A-4I. The device 30 of these implementations may also be referred to as an adaptor 30. The adaptor 30 of these implementations has a mounting plate 36 constructed and arranged to be selectively attached to the distal end of a boom (as shown in FIG. 2A at 12) and an attachment plate 42 is constructed and arranged to support a tool, in one example a dozer blade 60 on the boom 12, while other tools are contemplated. The mounting plate 36 and attachment plate 42 may be in opposite orientations such that the mounting plate 36 supports a tool and the attachment plate is attached to the boom.

In various implementations, the mounting plate 36 and adaptor plate 42 are substantially planar and are constructed and arranged to be selectively disposed adjacent to one another and secured when the tool, such as dozer blade 60 is attached. As described herein, in various implementations, these plates 36, 42 are fitted with a variety of additional components to allow for the mounting of the mounting plate 36 to the boom 12 and the attachment plate 42 to a tool, such that the tool can be selectively secured to the distal end of the boom 12 for use.

As shown in FIGS. 3A-3G, the mounting plate 36 is configured so as to form a male/female connection in reverse configuration. It would be appreciated that many alternate implementations are possible. It is understood that in these implementations, the attachment portions 32A-B are mounted, affixed or otherwise disposed substantially in parallel, so as to be substantially perpendicular to a mounting plate 36 and define a slot 33 therewith. In various implementations, the slot 33 is of sufficient width to accommodate the mounting of the mounting plate 36 such that the attachment portions 32A-B are disposed on either side of the end of the boom 12. Further implementations of the adaptor 30 having an alternate configuration of the mounting plate 36 and attachment plate 42 are shown in FIGS. 3A-3G. In these implementations, the substantially planar attachment portions 32A-B define boom openings 17 that can further comprise bushings 19 or other bearings for coupling to the boom 12 via fasteners 18 (not shown).

In the implementations of FIGS. 3A-3G, the mounting plate 36 further comprises paired elongate coupling flanges 41 that are disposed along either side of the mounting plate 36 and used to form a tongue and groove-style coupling with the attachment plate 42 via the receiving segments 43 of the implementations shown in FIGS. 4A-4I.

In turn, the attachment plate 42 depicted in the implementations of FIGS. 4A-4I has paired elongate female receiving segments 43 defining coupling slots 43A therewith disposed on either side of the attachment plate 42, which are constructed and arranged to receive the coupling flanges 41. In these implementations, coupling openings 45 are defined on either end of these segments 43 to allow for the flanges 41 to be secured within the slots 43A via fasteners or pins (not shown), as would be readily appreciated by the skilled artisan.

As shown in FIGS. 4A-4I, the attachment plate 42 may be coupled to a housing 48. In these implementations, the housing may be hollow and define several walls 48A, 48B, 48C, to which a plurality of tool brackets 52A, 52B, 52C can be attached. It would be appreciated that the tool brackets 52A, 52B, 52C can each have several tool flanges 54 defining tool openings 56 for use in mounting of various tools, as is described further herein. In various implementations, the housing 48 can further comprise a handle 49, constructed and arranged to allow the user to slide the attachment plate 42 and tool (not shown) into place on the mounting plate 36.

The attachment plate 42 and/or mounting plate 36 may additionally comprise a stop 47. The stop 47 disposed at one end of the attachment plate 42 and/or mounting plate 36 is constructed and arranged to stop the sliding motion of the adaptor 30 when the attachment/mounting plates 36, 42 are coupled.

FIGS. 5A-5E depict a tool bracket 52 for the mounting and support of a tool to the attachment plate 42, mounting plate, and/or housing 48, according to certain implementations. In these implementations, tool flanges 54A, 54B are disposed substantially parallel to one another and perpendicularly to the bracket plate 52A, to define a tool slot 53 therein. Each of these tool flanges 54A, 54B further defines a tool opening 56A, 56B for the attachment of the tool (not shown). Further, in these implementations, bushings 57A, 57B are disposed within the openings 56A, 56B to provide support and/or rotational communication with the tool pins or other fasteners used to secure the tool in place, as would be appreciated.

Figure 6A:
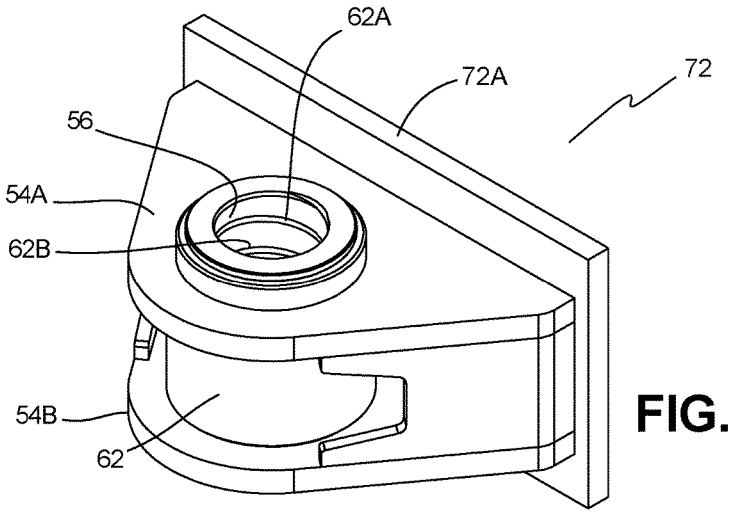
FIGS. 6A-6D depict the bracket which attaches to the tool, according some implementations.
Figure 6B:
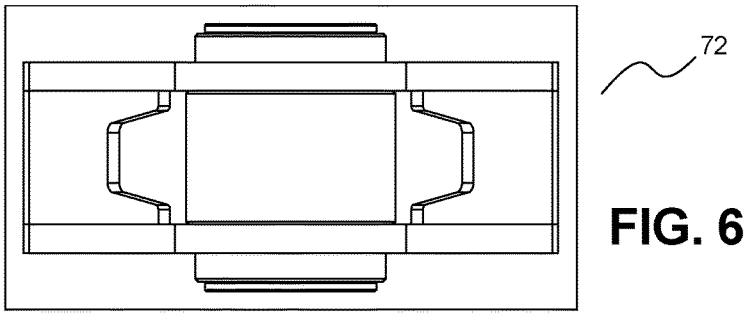
Figure 6C:
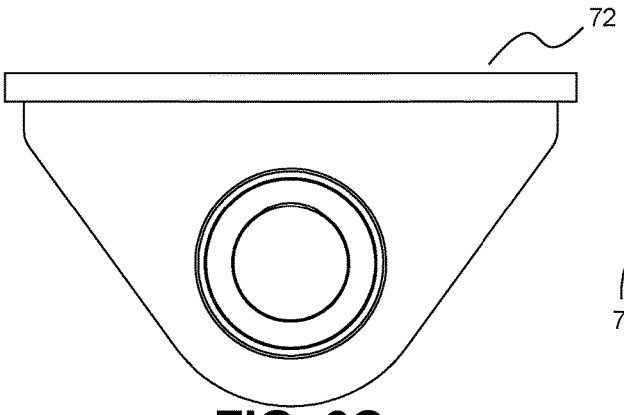
Figure 6D:
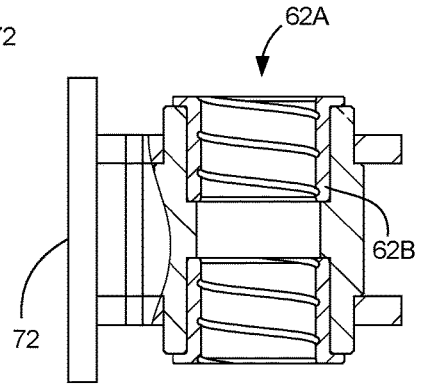

An alternate tool bracket 72 is shown in the implementations of FIGS. 6A-6D. In these implementations, a sleeve 62 is disposed between the flanges 54A, 54B within the opening 56. Bracket plate 72A is mounted to a tool. In these implementations, the sleeve 62 further defines a lumen 62A for the mounting of certain tools. In certain of these implementations, and as shown in FIG. 6D, the lumen 62A comprises bushings 62B constructed and arranged to provide support and/or rotational communication with the tool pins or other fasteners.

Figure 7A:
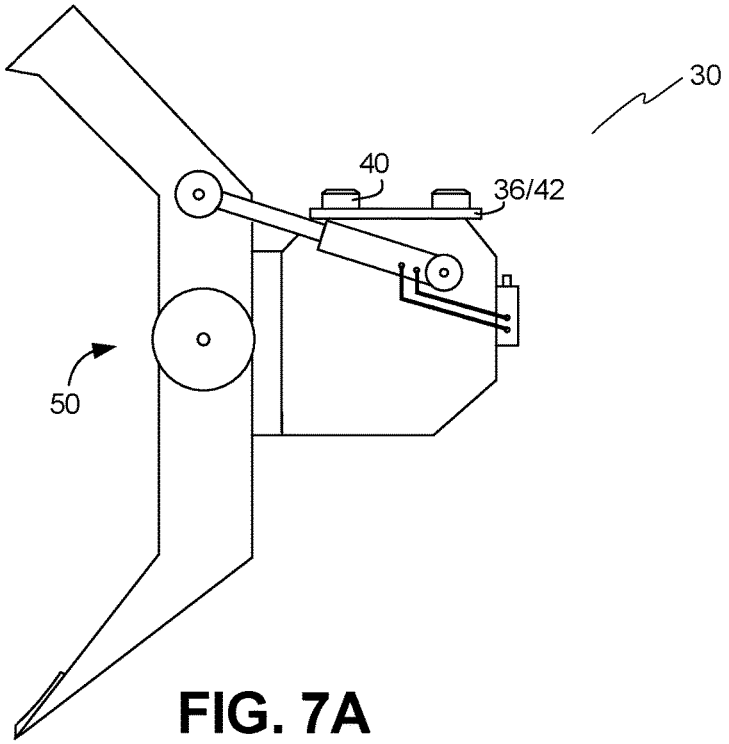
FIG. 7A is a side view of a grapple modified for use with the adaptor, according to one implementation.
Figure 7B:
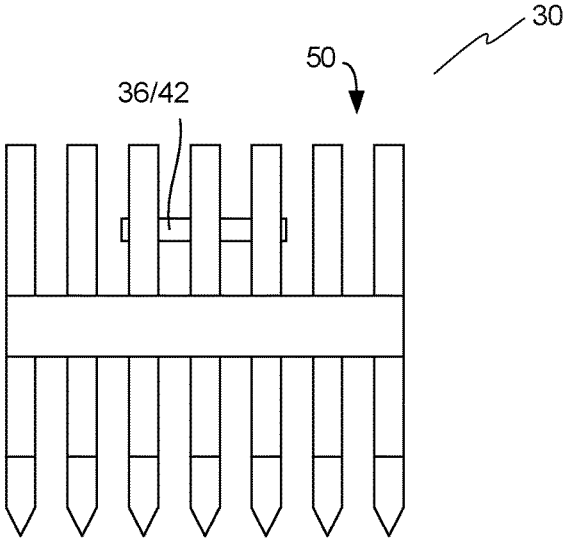
FIG. 7B is a front view of a grapple, according to one implementation.

FIGS. 7A and 7B depict a grapple 50 modified for use with the adaptor 30. These grapples 50 are useful in removing oversized objects from the ground being worked, such as boulders, tree roots and stumps, razed building materials and the like. An attachment plate 42 or mounting plate 36 has been mounted on the grapple 50. This attachment of the attachment plate 42 or mounting plate 36 allows for the grapple 50 to be easily, quickly and simply attached to or removed from the end of an excavator boom 12 that has been modified to carry the adaptor 30. It is understood that the tools modified for use with the adaptor 30 may vary based on the ability, experience, and preference of those skilled in the art.

Figure 7C:
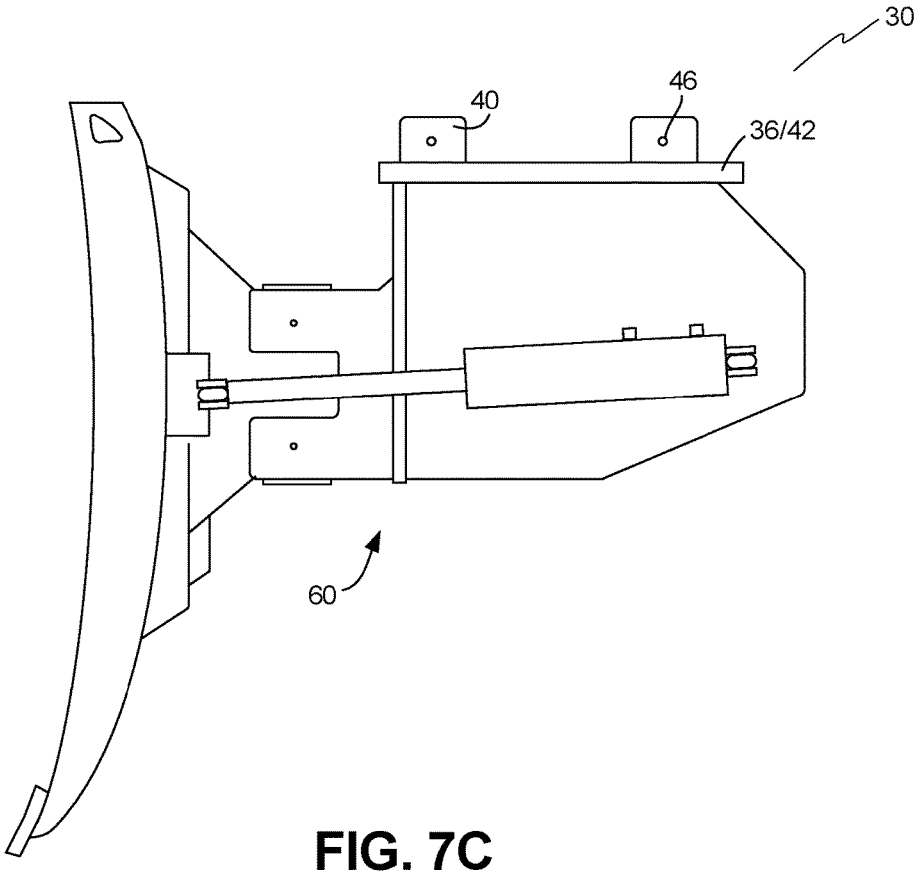
FIG. 7C is a side view of a dozer blade modified for use with the adaptor, according to one implementation.

FIG. 7C shows a dozer blade 60 modified for use with the adaptor 30. These dozer blades 60 are useful in shaping and levelling the ground being worked by an excavator 10 or other machine. An attachment plate 42 or mounting plate 36 of the adaptor 30 may be been mounted on the dozer blade 60 making the dozer blade 60 easily, quickly and simply attached to or removed from the end of an excavator boom 12 that has been modified to carry the adaptor 30. The attachment plate 42 inserts into the lumens 38 of the mounting plate of the the adaptor 30. It is understood that the tools modified for use with the adaptor 30 may vary based on the ability, experience, and preference of those skilled in the art.

Figure 7D:
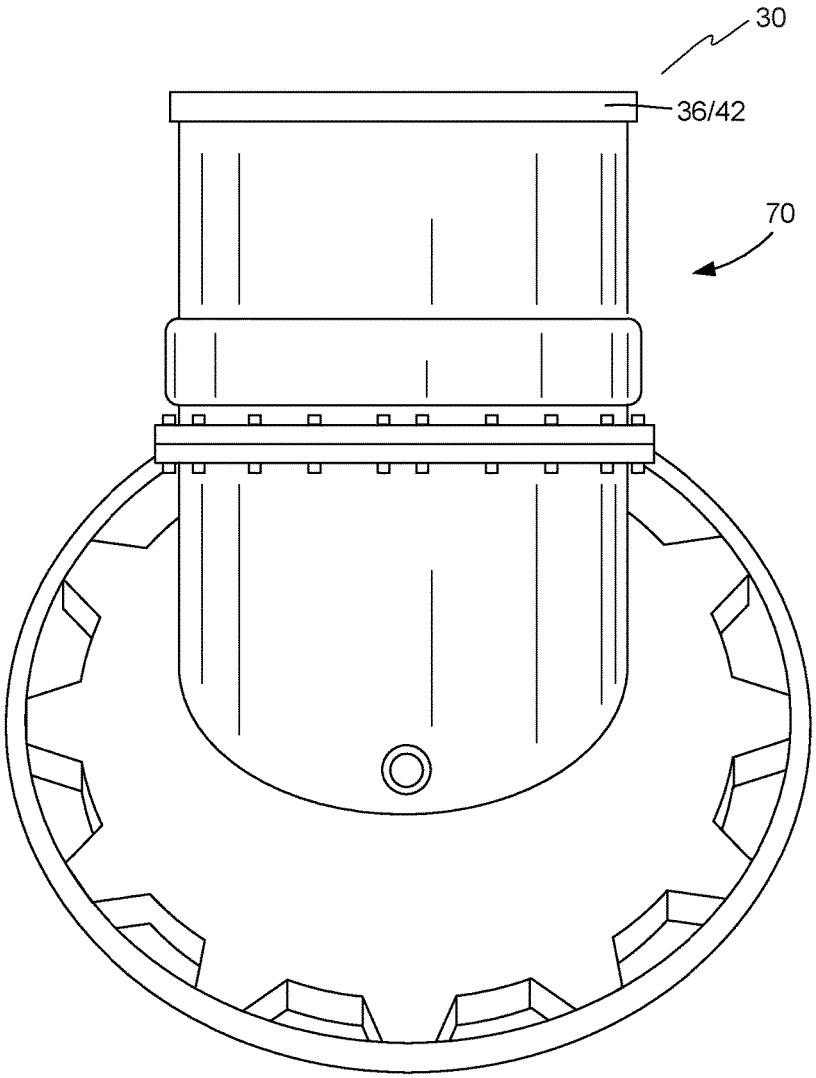
FIG. 7D is a side view of a vibrating compaction roller, according to one implementation.

FIG. 7D depicts a vibrating compaction roller 70 modified for use with the adaptor 30. These compaction rollers are useful in compacting and levelling the ground being worked by an excavator machine 10. An attachment plate 42 or mounting plate 36 may be mounted on the compaction roller 70. The attachment plate 42 and mounting plate 36 facilitate easy, quick and simple attachment and removal of the compaction roller 70 from the end of an excavator boom 12 that has been modified to carry the adaptor 30. The attachment plate 42 inserts into the mounting plate 36 of the adaptor 30. It is understood that the tools modified for use with the adaptor 30 may vary based on the ability, experience, and preference of those skilled in the art.

Figure 8A:
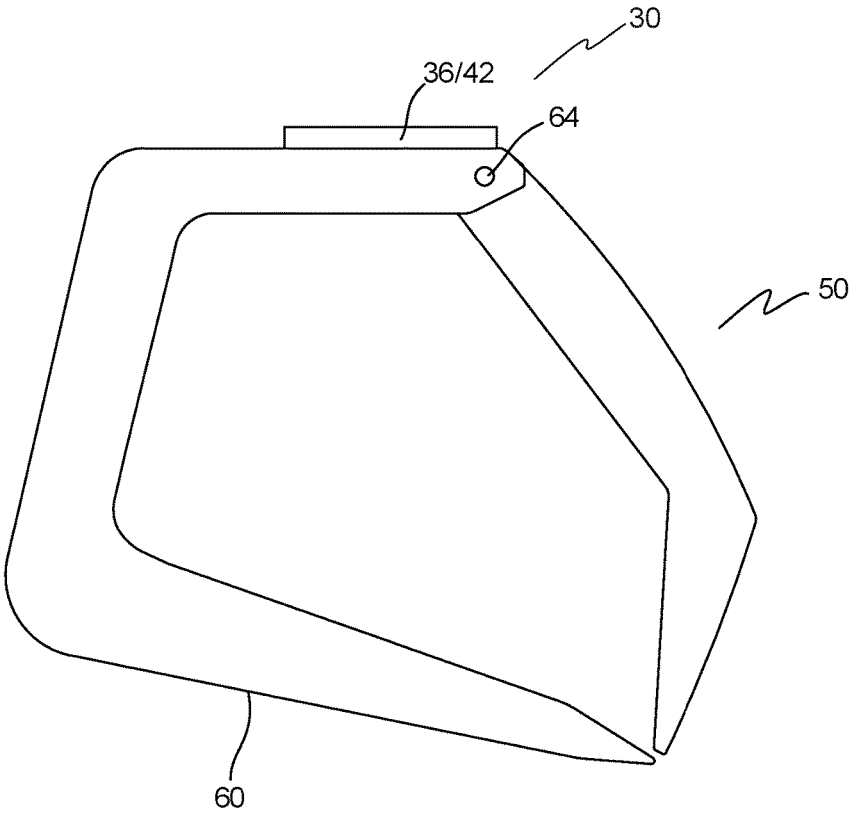
FIG. 8A is a side view of a tool comprising a grapple and a dozer blade, modified for use with the adaptor, according to one implementation.

FIG. 8A depicts an alternative embodiment of a tool which incorporates a grapple 50 and blade 60. The attachment plate 42 or mounting plate 36 is mounted to the blade 60. The grapple 50 moves freely around an axis centered about the joint 64.

Figure 8B:
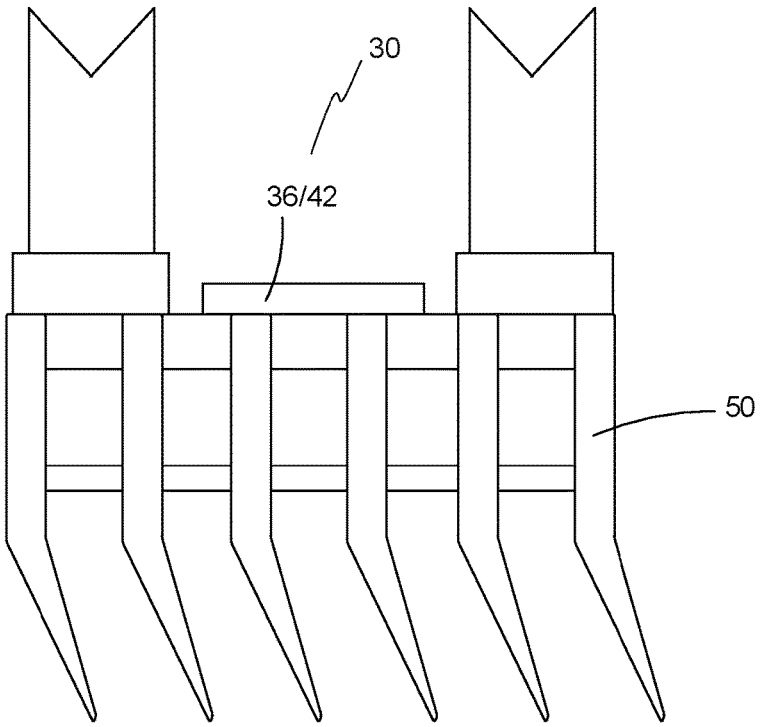
FIG. 8B is a front view of the grapple and dozer blade complex, modified for use with the adaptor, according to one implementation.

FIG. 8B shows an alternative embodiment of a grapple 50 and blade 60 complex. The attachment plate 42 or mounting plate 36 may be mounted on the grapple 50.

Figure 9A:
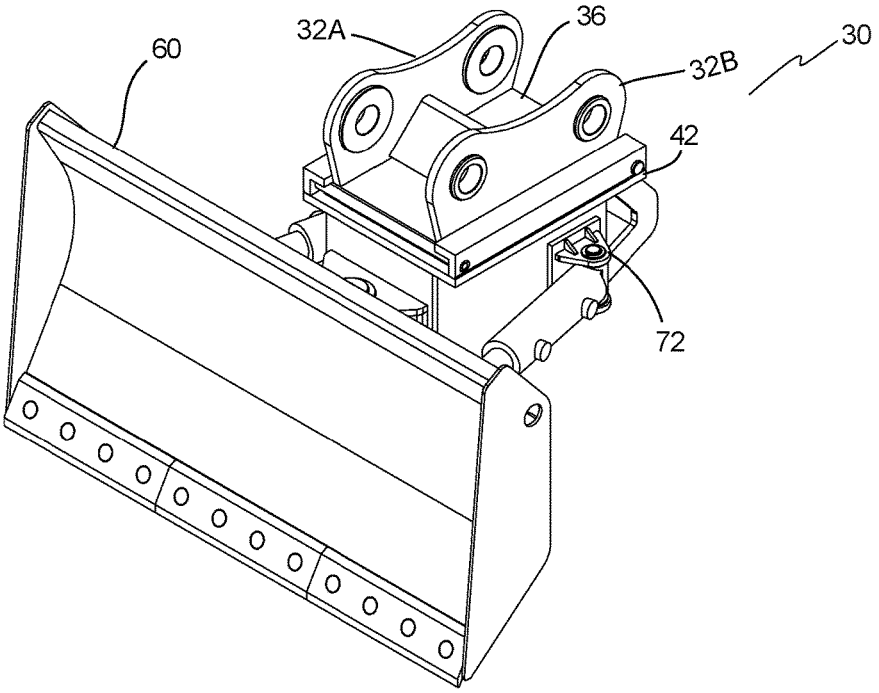
FIG. 9A depicts a perspective view of a dozer blade attached to the adaptor, according to one implementation.
Figure 9B:
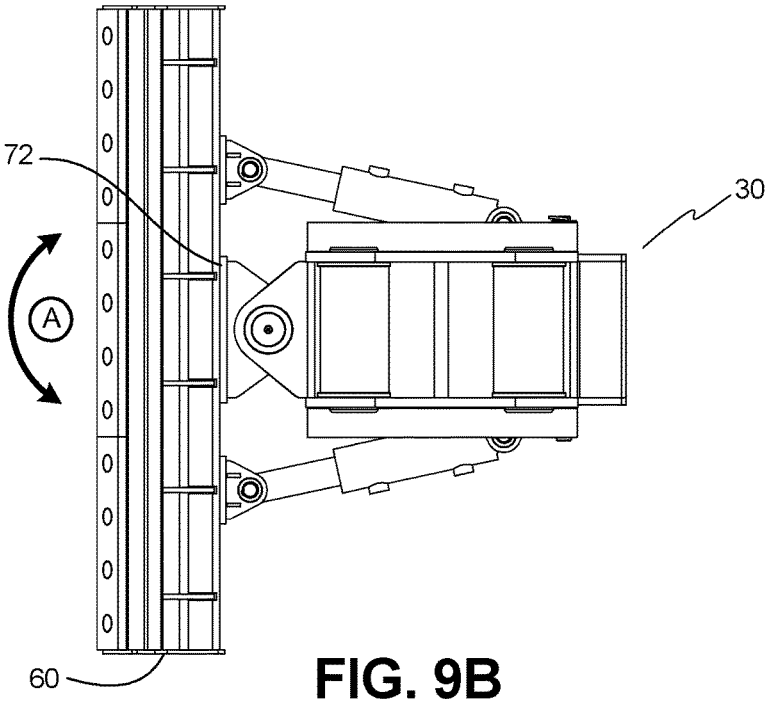
FIG. 9B depicts a top view of the blade as modified for use with various implementations of the adaptor, according to one implementation.
Figure 9C:
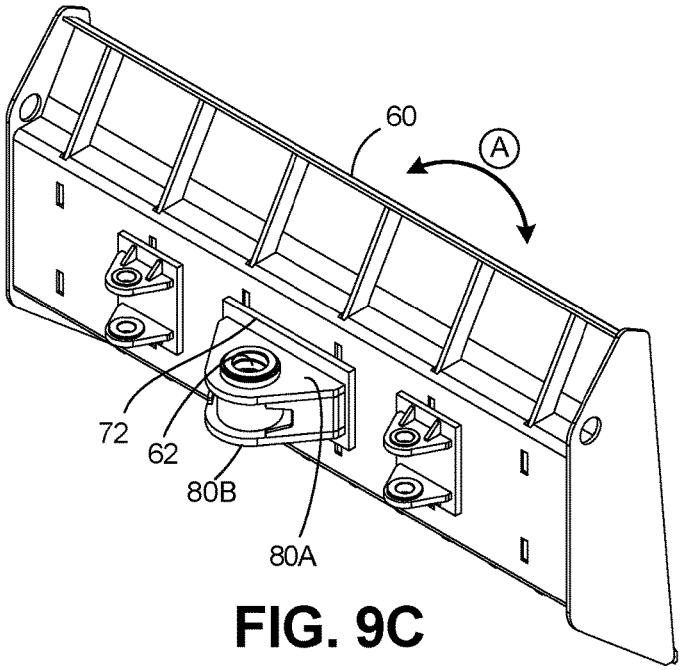
FIG. 9C depicts a rear perspective view of the blade implementation of FIG. 9B, according to one implementation.
Figure 9D:
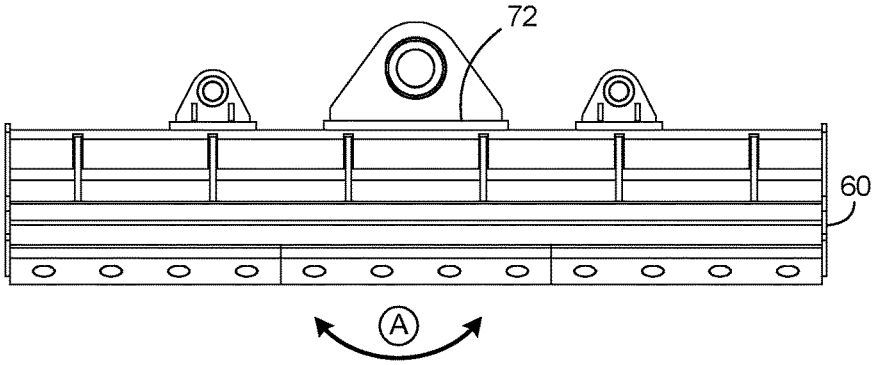
FIG. 9D is a further top view of the blade implementation of FIG. 9B, according to one implementation.

FIG. 9A-9D depict a dozer blade 60 modified for use with the adaptor 30. The bracket plate 72 attaches to the tool, mounted to the blade 60 in this implementation. As shown by FIG. 9A, the bracket plate 72 is moved along the blade 60. FIG. 9B depicts the blade 60 with bracket plate 72 attached to the tool. FIG. 9C depicts one implementation wherein the sleeve 62 is disposed between the flanges 80A, 80B. It is appreciated that the blade 60 can be pivoted relative to the boom 12 via hydraulics, along reference arrow A, as shown in FIGS. 9B-D.

Figure 10:
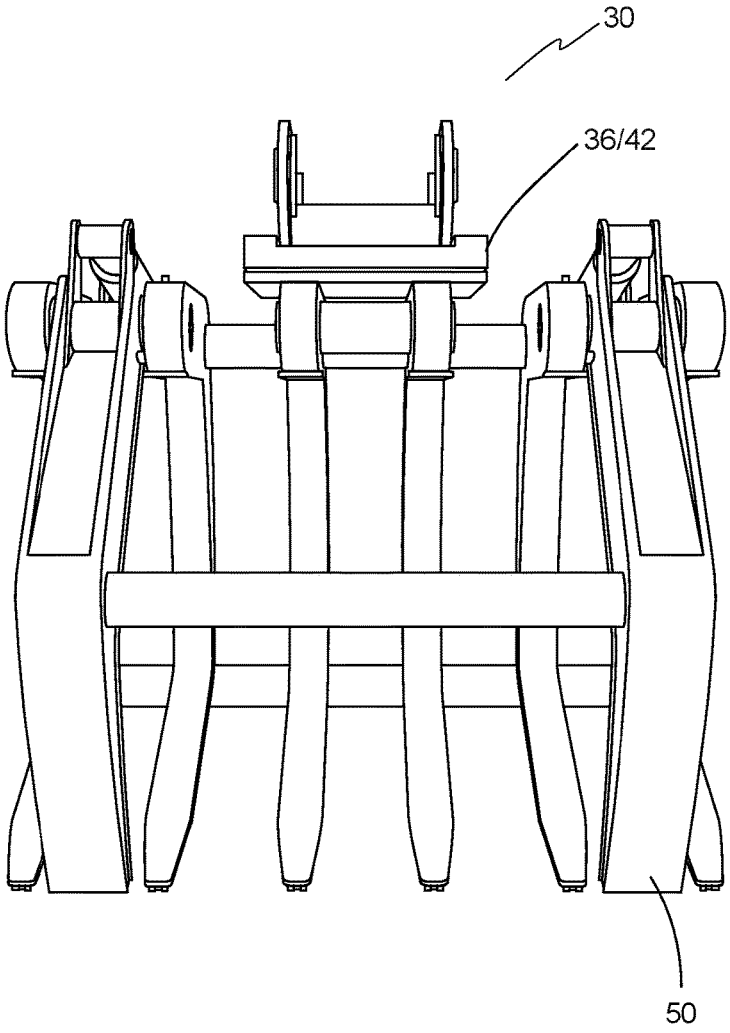
FIG. 10 depicts a front view of the grapple and adaptor, according to one implementation.

FIG. 10 depicts a grapple 50 in use with one implementation of the adaptor 30.

Figure 11:
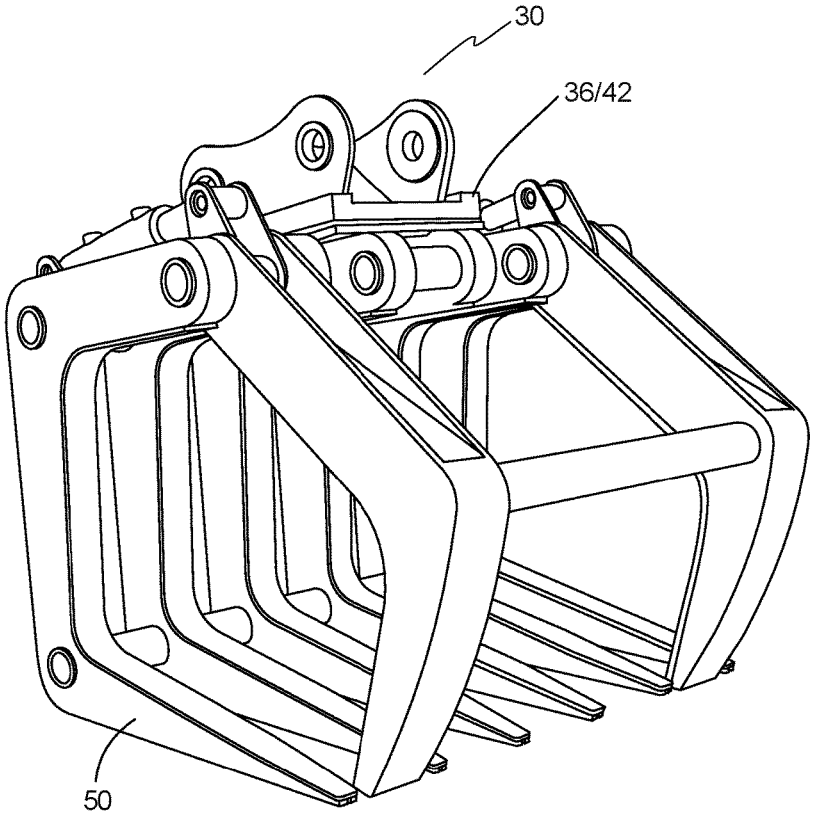
FIG. 11 depicts a perspective view of the grapple and adaptor, according to one implementation.

FIG. 11 shows another view of the grapple 50 in use with the adaptor 30, according to the implementation depicted in FIG. 10.

Figure 12:
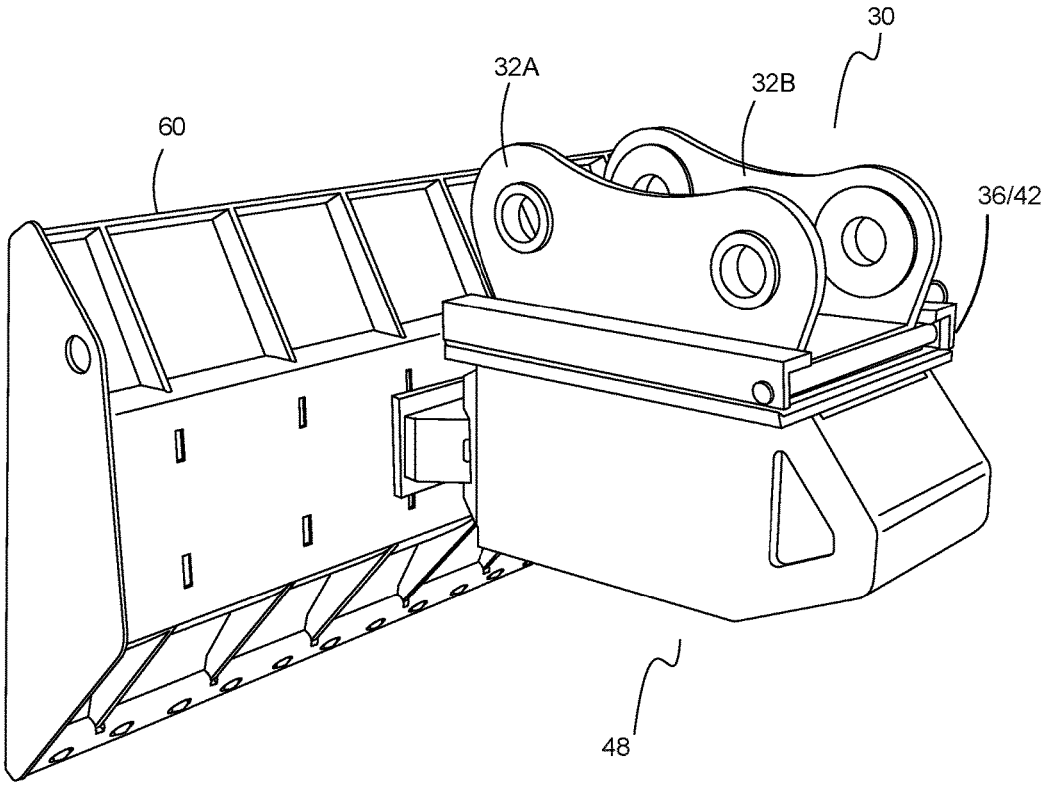
FIG. 12 depicts a rear perspective view of the dozer blade and adaptor, according to one implementation.

FIG. 12 depicts a dozer blade 60 in use with the adaptor 30 with a housing 48, according to one implementation.

Figure 13:
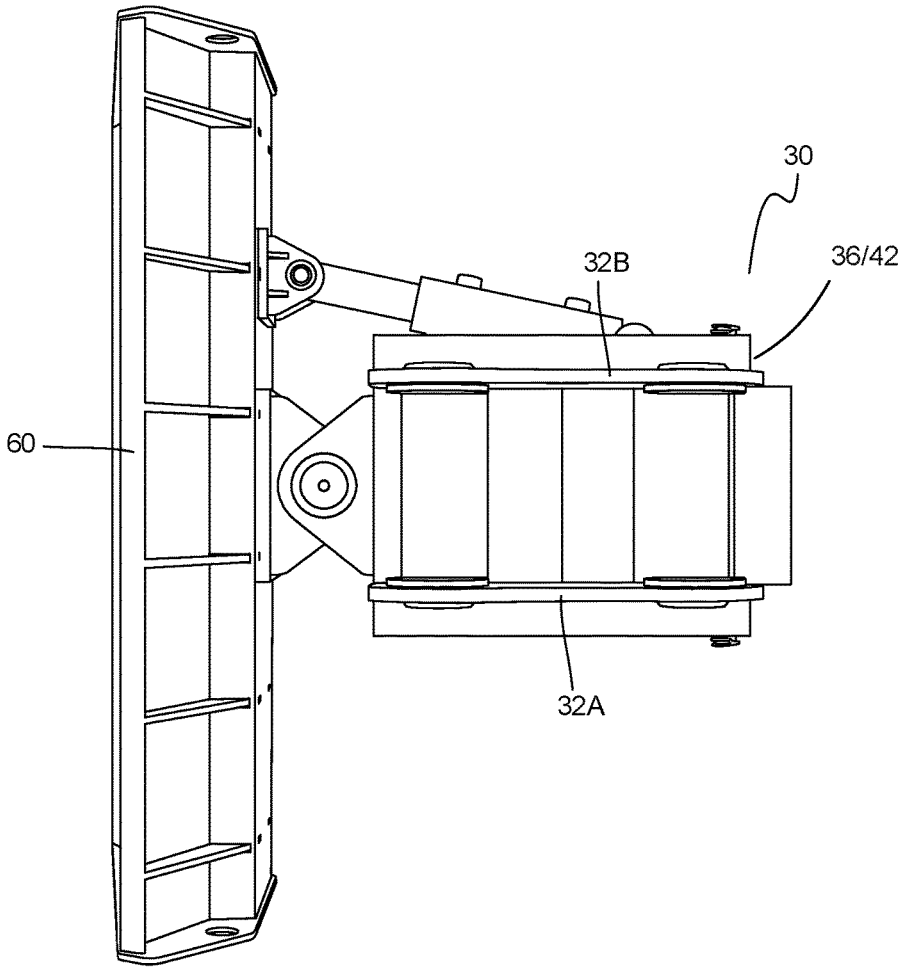
FIG. 13 depicts a top view of the dozer blade and adaptor of FIG. 12, according to one implementation.

FIG. 13 depicts a top view of the dozer blade 60 in use with the adaptor 30, according to the implementation shown in FIG. 12.

Figure 14A:
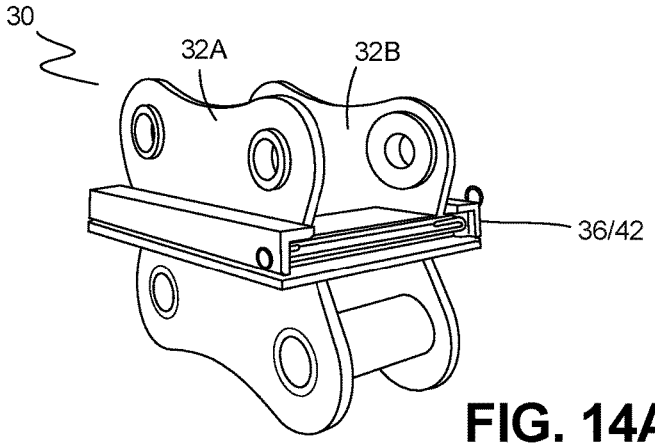
FIG. 14A shows a perspective view of the adaptor, according to one implementation.
Figure 14B:
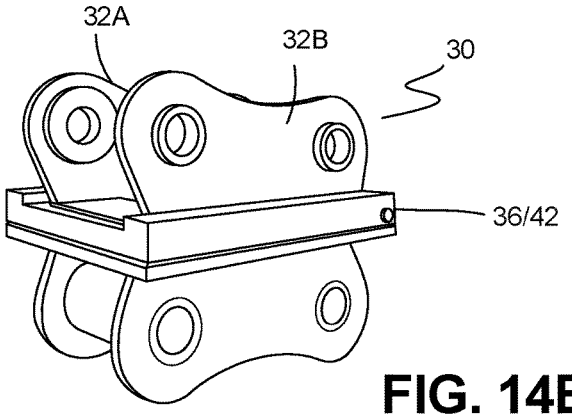
FIG. 14B shows another perspective view of the adaptor implementation of FIG. 14A, according to one implementation.
Figure 14C:
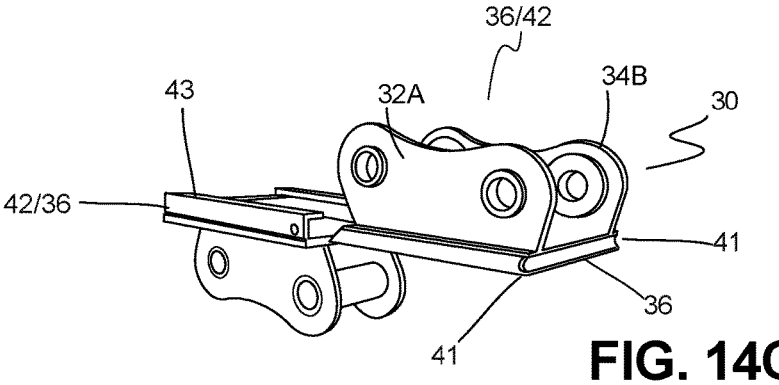
FIG. 14C shows a perspective view of the adaptor of FIGS. 14A and 14B in an uncoupled configuration, according to one implementation.

FIGS. 14A-14C depict the adaptor 30 in coupled and disengaged positions. The attachment portions 32A-B are shown for mounting the adaptor 30 to an implement and/or tool. FIG. 14A shows the adaptor 30 in a coupled position. FIG. 14B shows another view of the adaptor 30, according to an exemplary embodiment. FIG. 14C shows the adaptor 30 aligned but in a disengaged or uncoupled position.

The foregoing description and drawings comprise illustrative embodiments of the disclosed embodiments. The foregoing embodiments and the methods described herein may vary based on the ability, experience, and preference of those skilled in the art. Merely listing the steps of the method in a certain order does not constitute any limitation on the order of the steps of the method. The foregoing description and drawings merely explain and illustrate the invention, and the invention is not limited thereto, except insofar as the claims are so limited. Those skilled in the art who have the disclosure before them will be able to make modifications and variations therein without departing from the scope of the invention.

I claim:

1. A mounting system for attaching implements on a boom, the mounting system comprising:

a. a universal rectangular mounting plate comprising:
   i. first and second upright attachment portions with openings defined therein constructed and arranged to be selectively secured to the boom;
   ii. a first elongate coupling flange disposed on a first side of the mounting plate; and
   iii. a second elongate coupling flange disposed on an opposite side of the mounting plate;

b. a first rectangular attachment plate coupled to an excavator bucket for securement of the excavator bucket to the universal planar mounting plate, the first attachment plate comprising first attachment plate receiving segments disposed in parallel so as to accommodate passage of the universal rectangular coupling flanges and at least one opening for receiving a pin; and c. a second rectangular attachment plate directly physically integrated into a second implement for securement of the second implement to the universal planar mounting plate, the second attachment plate comprising second attachment plate receiving segments disposed in parallel so as to accommodate passage of the planar mounting plate coupling flanges, a hollow housing disposed opposite the mounting plate, the hollow housing defined by a plurality of walls and at least one opening for receiving a pin, wherein the second implement is selected from a group consisting of a grapple and a blade.

2. The mounting system of claim 1, wherein the housing comprises at least one tool bracket.

3. The mounting system of claim 2, wherein the tool bracket is configured to couple to the second implement.

4. The mounting system of claim 3, wherein the housing comprises a handle.

5. The mounting system of claim 4, further comprising a stop disposed between the receiving segments of the first attachment plate.

6. A method of mounting a plurality of implements to an excavator boom, the method comprising:

a. securing a rectangular universal mounting plate to the excavator boom, the rectangular universal mounting plate comprising:
   i. first and second planar upright attachment portions having mounting openings defined therein for coupling to the excavator boom; and
   ii. first and second elongate coupling flanges disposed on opposite sides of the rectangular universal mounting plate;

b. securing the boom to an excavator bucket, wherein the excavator bucket is coupled to a first rectangular attachment plate comprising:
   i. a first elongate receiving segment defining a second coupling slot; and
   ii. a second elongate receiving segment defining a second coupling slot;

wherein the excavator bucket is secured by a pin after slidably inserting the first and second elongate coupling flanges into the first and second coupling slots of the first rectangular attachment plate;

c. detaching the boom from the excavator bucket and re-securing the boom to a second implement, wherein the second implement comprises a second rectangular attachment plate comprising:
   i. a first elongate receiving segment defining a first coupling slot; and
   ii. a second elongate receiving segment defining a second coupling slot; and
   iii. a hollow housing disposed on the universal attachment plate opposite the planar mounting plate, the hollow housing defined by a plurality of walls, and wherein the second implement is secured by a pin after slidably inserting the first and second elongate coupling flanges into the first and second coupling slots of the second rectangular attachment plate, and wherein the second implement is selected from a group consisting of a grapple and a blade.

7. The method of claim 6, wherein the housing comprises at least one tool bracket.

8. The method of claim 7, wherein the tool bracket is configured to couple to the second implement.

9. The method of claim 8, wherein the housing comprises a handle.

10. The mounting system of claim 9, wherein the further comprising a stop disposed between the first and second elongate receiving segments.

11. A mounting system for attaching implements on a boom having attachment ears, the mounting system comprising:

a. a universal planar mounting plate comprising:

i. a rectangular, planar plate having first and second ends, first and second sides and front and back faces;

ii. a plurality of upright attachment portions defining openings and disposed adjacent the back side and constructed and arranged to be selectively secured to the attachment ears of the boom;

iii. a first elongate coupling flange disposed on the first side; and iv. a second elongate coupling flange disposed on the second side;

b. a first attachment plate coupled to an excavator bucket for securement of the first implement to the universal planar mounting plate, the attachment plate comprising first implement coupling slots disposed in parallel on opposite sides of the first attachment plates so as to accommodate passage of the first and second coupling flanges and at least one opening for receiving a pin; and c. a second attachment plate integrated directly into a second implement for securement of the second implement to the universal planar mounting plate, the second attachment plate comprising second implement coupling slots disposed in parallel on opposite sides of the second attachment plate so as to accommodate passage of the first and second coupling flanges, a hollow housing disposed opposite the universal planar mounting plate, the hollow housing defined by a plurality of walls, and at least one opening for receiving a pin, wherein the second implement is selected from a group consisting of at least one of a grapple and a blade.

12. The mounting system of claim 11, wherein the second rectangular attachment plate comprises a housing disposed opposite the mounting plate.

13. The mounting system of claim 12, wherein the housing comprises at least one tool bracket.

14. The mounting system of claim 13, wherein the tool bracket is configured to couple to the second implement.

15. The mounting system of claim 14, wherein the housing comprises a handle.

16. The mounting system of claim 15, wherein the first attachment plate further comprises a stop between the coupling slots.

* * * * *